United States Patent [19]

Rich

[11] 4,126,808

[45] Nov. 21, 1978

[54] HIGH VOLTAGE TWO STAGE TRIGGERED VACUUM GAP

[75] Inventor: Joseph A. Rich, Schenectady, N.Y.

[73] Assignee: Electric Power Research Institute, Inc., Palo Alto, Calif.

[21] Appl. No.: 830,211

[22] Filed: Sep. 2, 1977

[51] Int. Cl.[2] ..... H01J 21/20

[52] U.S. Cl. ..... 313/198; 313/217; 313/231.1; 313/325

[58] Field of Search ..... 313/198, 217, 231.1, 313/231.4, 325; 317/62

[56] References Cited

U.S. PATENT DOCUMENTS

| | | | |
|---|---|---|---|
| 3,465,192 | 9/1969 | Lafferty | 313/198 X |
| 3,798,484 | 3/1974 | Rich | 313/198 |

OTHER PUBLICATIONS

Farrell, "IEEE Transaction on Electron Devices", Apr. 1966, pp. 432–438.

Lafferty, "Proc. IEEE", Jan. 1966, pp. 23–32.

*Primary Examiner*—Rudolph V. Rolinec

*Assistant Examiner*—Darwin R. Hostetter

[57] ABSTRACT

A triggered vacuum gap tube includes an evacuated envelope with high voltage terminals at opposite ends of the envelope. The envelope is divided into two chambers by a mid-plate therein having a centrally located aperture therethrough. The first of the two chambers has an end plate mounting one of the high voltage terminals and also mounting an array of rods or electrodes which extend inwardly toward the mid-plate. The second of the two chambers also has an end plate mounting the other high voltage terminal and also having an array of rods or electrodes extending therefrom toward the mid-plate. The mid-plate has mounted therein an array of through rods or electrodes which extend in one direction into the first chamber and in the opposite direction into the second chamber. The through mid-plate mounted electrodes lie in side-by-side spaced relation with the end plate mounted electrodes in both the first and second chambers. The end plate mounted arrays of electrodes have a centrally disposed electrode with a tip which is proximate to the centrally located aperture in the mid-plate. A plasma trigger is mounted in the tip of one of the centrally disposed electrodes. When a high voltage is connected across the high voltage terminals and a trigger signal is applied to the plasma trigger, a high arc current transits the electrodes and the evacuated spaces therebetween in both the first and second chambers. The arc current occurs substantially simultaneously and has the same magnitude in both chambers.

5 Claims, 3 Drawing Figures

HIGH VOLTAGE TWO STAGE TRIGGERED VACUUM GAP

BACKGROUND OF THE INVENTION

This invention relates to triggered vacuum gaps, and more specifically to a two stage triggered vacuum gap for use in high voltage applications where circuit interruption problems are likely to occur.

Two stage triggered vacuum gap devices are known which are operable during overload conditions to conduct overload current in an arc across an interelectrode gap, and to subsequently extinguish the arc. Greatly increased current conduction is obtained in such devices through a conductive plasma injected into the interelectrode gap during desired conducting periods, such as during overload conditions. Extensive studies have been conducted relating to the manner in which vacuum gaps are triggered to conduct current and to investigate the characteristics of the triggered vacuum gap. Two representative studies are discussed in "Triggered Vacuum Gaps," J. M. Lafferty, Proceedings of the IEEE, Volume 54, No. 1, Page 23, January, 1966, and "Low Voltage Firing Characteristics of a Triggered Vacuum Gap," George A. Farrall, IEEE Transactions on Electron Devices, Volume ED-13, No. 4, Page 432, April, 1966. U.S. Pat. No. 3,465,192 further discusses triggerable arc discharge devices and the manner in which plasma triggers may be constructed for use therein. A two stage triggered vacuum gap is disclosed in U.S. Pat. No. 3,798,484 having a plasma trigger mounted in an electrically floating midsection between the two stages in one case, and having the plasma trigger mounted in one of the end plates associated with one of the tube sections in the other case.

There is a need, therefore, for a two stage triggered vacuum gap device which is readily and reliably triggered by a plasma injection so that current conduction occurs simultaneously in each of the stages.

SUMMARY AND OBJECTS OF THE INVENTION

In general, a two stage triggered vacuum gap device is disclosed having a sealed enclosure with a mid-plate contained therein separating the enclosure into first and second chambers. The mid-plate has a centrally disposed aperture therethrough and serves as a mount for an array of through electrodes which extend from the mid-plate toward opposite ends of the sealed enclosure. An end plate defines each end of the sealed enclosure. Each end plate carries an array of electrodes mounted in and extending from the end plates toward the mid-plate in such a fashion that electrodes in the array mounted on each end plate lie in spaced side-by-side relation with ones of the through electrodes mounted in the mid-plate. The electrodes are thus in interleaved spaced relationship within the first and second chambers. The arrays of electrodes mounted in the opposite end plates include a centrally disposed electrode. A plasma trigger is mounted in the tip of one of the centrally disposed electrodes such that it overlies the centrally disposed aperture. As a consequence, when a trigger signal is connected across the sealed enclosure, a substantially simultaneous high arc current is initiated to flow through the electrodes and the interelectrode space in the first and second chambers.

It is an object of the present invention to provide a two-stage triggered vacuum gap device providing a high voltage interruption capability by cascading electrode arrays within a single evacuated enclosure.

Another object of the present invention is to provide a two-stage triggered vacuum gap device in which both stages of a cascaded electrode array are triggered to conducts substantially simultaneously.

Another object of the present invention is to provide a two-stage triggered vacuum gap device which is positively controlled to react substantially instantaneously on command.

Another object of the present invention is to provide a two-stage triggered vacuum gap device which will handle large arcing current without severe damage to the electrodes.

Another object of the present invention is to provide a two-stage triggered vacuum gap device which does not develop an excessive amount of metal vapor during the arcing phase.

Additional objects and features of the invention will appear from the following description in which the preferred embodiment has been set forth in detail in conjunction with the accompanying drawings.

DESCRIPTION OF THE PREFERRED EMBODIMENT

Figure 1:
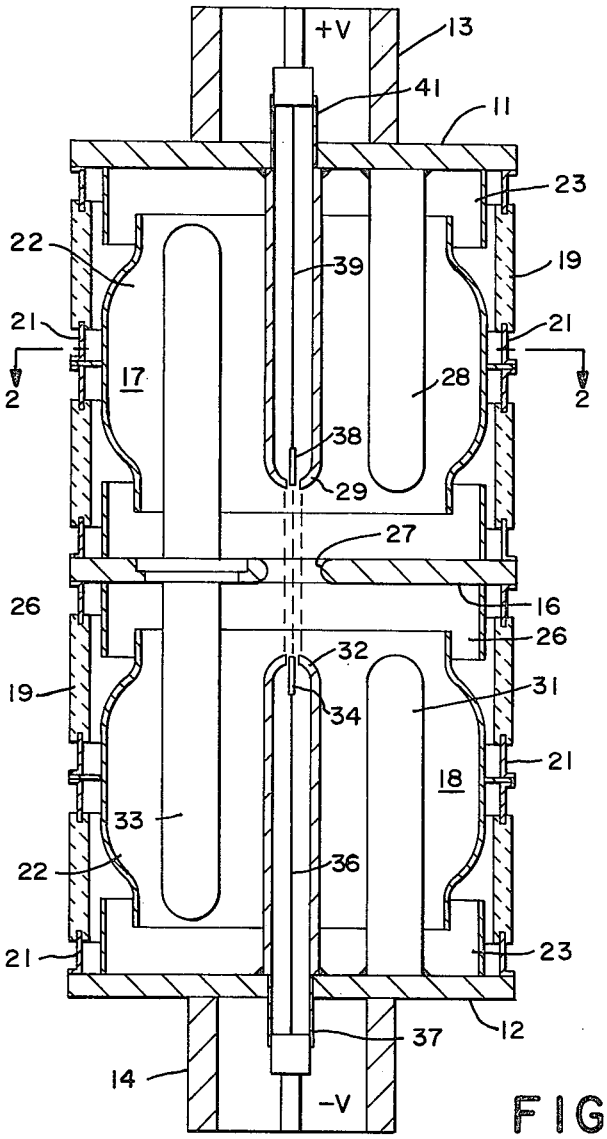
FIG. 1 is a side sectional view of a two-stage triggered vacuum gap tube.

FIG. 1 shows a two-stage vacuum gap tube enclosing an evacuated space and having an anode end plate 11 and an opposite cathode end plate 12. Anode end plate 11 supports an anode terminal 13, and cathode end plate 12 supports a cathode terminal 14. A mid-plate 16 is shown dividing the enclosure into an upper anode chamber 17 and a lower cathode chamber 18. End plates 11 and 12 and mid-plate 16 are joined together by a wall constructed of alternating insulating bands 19 and metal bands 21. Floating shields 22 are connected to floating metal bands 21 in chambers 17 and 18, and end shields 23 are mounted on each of the anode and cathode end plates 11 and 12. Mid shields 26 are located in each of the upper and lower chamber 17 and 18, mounted on mid plate 16. An aperture 27 is shown centrally located through mid plate 16.

An array of rods or electrodes 28 are shown mounted on anode end plate 11 extending into the upper anode chamber 17 toward mid plate 16, but stopping short thereof. The array of electrodes 28 includes a centrally disposed electrode 29 extending from anode end plate 11 toward mid plate 16 and having a tip or free end overlying aperture 27.

In like manner, cathode end plate 12 has an array of rods or electrodes 31 mounted therein and extending toward mid plate 16, but stopping short thereof. Array of electrodes 31 includes a centrally disposed electrode 32 mounted in cathode end plate 12 and extending toward mid plate 16 such that the tip or free end of electrode 32 is proximate to aperture 27. An array of through electrodes 33 is mounted in mid plate 16, extending therethrough, and reaching toward anode end plate 11 in one direction and toward cathode end plate 12 in the opposite direction, but stopping short of each of the anode and cathode end plates 11 and 12.

The rods or electrodes 28, 31 and 33 may be either hollow or solid depending upon the material utilized. The desirability of hollow rods or electrodes relative to solid construction is discussed in some detail in copending patent application, Ser. No. 848,512, filed Nov. 4, 1977. The electrodes may be made of Vascomax* or copper, if the copper is reinforced. If the rods are of solid construction, Vascomax* is the preferred material, after which copper is desirable, if the solid rods are reinforced by a steel core or by Vascomax* steel cladding. Ordinarily, the Vascomax* material, which is 18 percent nickel steel, and the copper material are available in vacuum melted form, and are relatively gas free.
*Trademark The centrally disposed electrode 32 is hollow in construction, and has mounted near the tip thereof a plasma trigger 34. A lead 36 extends down through hollow electrode 32, exiting through a seal 37 for external access and application of a trigger signal. It should be noted that plasma trigger 34 is available in different types. There is available a titanium hydride gas trigger, which initiates breakdown of the vacuum gap by injection into the gap region of a minute quantity of ionized hydrogen from the trigger. A gas trigger cannot be used for hermetically sealed tubes. Therefore, plasma trigger 34 would take the form of a "metal" trigger, which is able to withstand the high temperatures necessary in the processing of sealed enclosures for the vacuum gap tube. The metal triggers depend for their operation on the vaporization and subsequent ionization in the gap space of a small quantity of metal in the trigger. Triggers available for use in this invention are discussed in U.S. Pat. No. 3,465,192, to which reference was made in the background of this disclosure.

While only a single plasma trigger 34 is necessary, it may be appropriate to construct centrally disposed electrode 29 in hollow form also. If such construction is used, an additional plasma trigger 38 may be mounted near the tip of centrally disposed electrode 29 overlying aperture 27 in mid plate 16. A lead 39 extends from additional plasma trigger 38 through the hollow core of centrally disposed electrode 29, and exits through a seal 41 for external access. The availability of additional plasma trigger 38 may be for purposes of redundancy, or it may be desirable to change polarity between the anode and cathode terminals 13 and 14, making terminal 14 the anode and terminal 13 the cathode. In this latter case, firing of the vacuum gap would be initiated by a signal transmitted to additional plasma trigger 38, since it is well known that there is a definite polarity effect in triggered gaps. The initiation of arc current in gaps is always easiest when the potential at the anode is substantially higher than that of the trigger assembly. Therefore, the trigger assembly is situated in the cathode. It is possible to initiate an arc current in the interelectrode gaps by transmitting a signal to an anode located trigger. However, in such an operational mode a comparatively long period of time is required before the arc current occurs. The initiation of arc current is substantially instantaneous for a cathode located plasma trigger as compared to something in the order of 6.5 milliseconds for arc current initiation by an anode located trigger.

Figure 2:
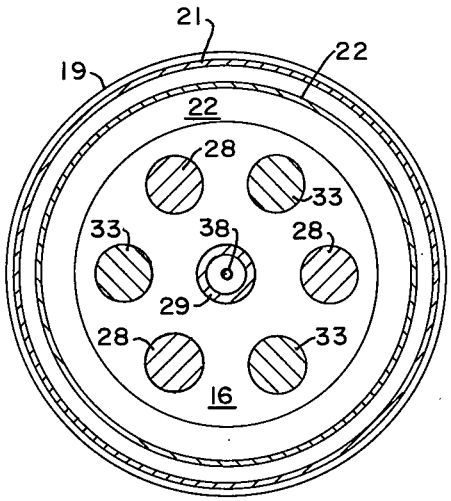
FIG. 2 is a sectional view along the line 2—2 of FIG. 1.

Turning now to FIG. 2 of the drawings, the interleaving of the electrodes 33 and 28 in upper anode chamber 17 is shown. The same relative spacing exists for electrodes 33 and 31 in the lower cathode chamber 18. Electrodes 28 and 33 are seen in FIG. 2 to be in side-by-side spaced relationship between adjacent electrodes of opposite polarity. Large effective gap lengths are obtained by the cascading of the rod arrays in upper and lower chambers 17 and 18. As a consequence, a higher interruption voltage capability results and a more compact enclosure is obtained.

Figure 3:
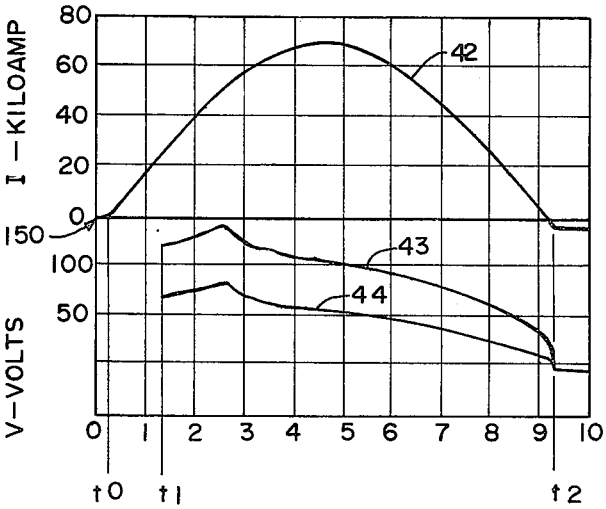
FIG. 3 is a graphical representation of the conducting characteristics of the two-stage triggered vacuum gap device of FIG. 1.

FIG. 3 is a graph showing current through the triggered vacuum gap device disclosed herein and the voltage drops associated with the two chambers during one-half cycle of a 60 Hertz wave. In this example the vacuum gap device was fired using the plasma trigger 34 alone, with additional plasma trigger 38 disabled. Current reached a 70 Kiloamp peak. The trigger signal was connected and a current trace 42 shows a rise starting substantially instantaneously thereafter at time $t_0$. The initial voltage transients are too high for test equipment to read, which explains the lack of a voltage trace during the period $t_1-t_0$. A voltage trace 43 represents the voltage drop across chambers 17 and 18 in series. Voltage trace 44 represents the voltage drop across chamber 18. It may be seen that the voltage traces are substantially similar in shape, having an initial noisy portion which is attributed to the launching of the arc plasma on a few of the interleaved rods or electrodes. The subsequent propagation of the arc current through the evacuated spaces between all the rods is associated with the smooth latter portion of the voltage traces 43 and 44. The current and voltage traces 42, 43 and 44 of FIG. 3 illustrate that a single cathode mounted plasma trigger 34 as seen in FIG. 1 will cause arc current conduction through cascaded evacuated chambers 17 and 18 substantially simultaneously in essentially immediate response to a trigger signal transmitted to the plasma trigger 34.

A two-stage triggered vacuum gap device has been disclosed which allows the effective gap spacing between rods of opposite polarity to be increased, thereby obtaining higher interruption voltage capability. High arc currents may be drawn through the device without severe electrode damage, and a low level of metal vapor is discharged from the electrodes into the evacuated space therearound during the current arcing phase.

What is claimed is:

1. A two stage triggered vacuum gap device, comprising a sealed enclosure, a mid plate separating said sealed enclosure into first and second chambers, said mid plate having a centrally disposed aperture, an end plate defining the end of said sealed enclosure in each of said first and second chamber, an array of end plate electrodes mounted in and extending from each of said end plates toward said mid plate, an array of mid plate electrodes mounted on said mid plate and extending therefrom toward each of said end plates, said end plate electrodes and mid plate electrodes being spaced and arranged whereby ones in said array of end plate electrodes and array of mid plate electrodes lie in spaced side by side relation within each of said first and second chambers, said array of end plate electrodes each including a centrally disposed electrode extending toward said centrally disposed aperture and terminating adjacent thereto, and a plasma trigger mounted in the tip of one of said centrally disposed electrodes adjacent said centrally disposed aperture, whereby a trigger signal applied to said plasma trigger when a high voltage is connected between a said array of electrodes in said first chamber and said array of electrodes in said second chamber causes substantially simultaneous high arc current flow through said first and second chambers.

2. A two stage triggered vacuum gap device as in claim 1 wherein said sealed enclosure comprises a dielectric wall section, together with a shield disposed between said dielectric wall section and said electrodes, whereby vapor emanating from said electrodes during arc current flow is prevented from condensing on and short circuiting said dielectric wall section.

3. A two stage triggered vacuum gap tube, comprising a sealed enclosure surrounding an evacuated space, a mid plate dividing said sealed enclosure into anode and cathode chambers, said mid plate having a centrally disposed aperture therein, an anode chamber end plate, an array of anode electrodes mounted on and extending from said anode chamber end plate toward said mid plate, a cathode chamber end plate, an array of cathode electrodes mounted on and extending from said cathode chamber end plate toward said mid plate, one of said cathode electrodes being centrally located and having a tip proximate to said centrally disposed aperture, an array of mid plate mounted electrodes extending into said anode chamber in one direction and said cathode chamber in the opposite direction, said mid plate mounted electrodes assuming position in spaced side by side relation with said anode and cathode electrodes, and a plasma trigger mounted in said centrally located cathode electrode tip, so that when a high voltage is impressed across said anode and cathode electrodes and a trigger signal is connected to said plasma trigger an arc current begins to flow through said anode and cathode chambers substantially simultaneously, and the voltage differential from anode end plate to mid plate is similar to the voltage differential from mid plate to cathode end plate.

4. A vacuum gap tube as in claim 3 wherein said sealed enclosure includes a dielectric wall section between said anode and cathode end plates, and a shield mounted between said electrodes and said dielectric wall section, whereby metal vapor emanating from said electrodes during arc current duration is substantially blocked from condensing on said dielectric wall section.

5. A vacuum gap tube as in claim 3 wherein said array of anode electrodes includes a centrally located electrode having a tip proximate to said centrally disposed aperture, an additional plasma trigger mounted in said tip of said centrally located anode electrode, whereby an additional trigger signal connected to said additional plasma trigger initiates the arc current when the high voltage polarity is reversed.

* * * * *